US008495834B2

(12) United States Patent
Harlow et al.

(10) Patent No.: US 8,495,834 B2
(45) Date of Patent: Jul. 30, 2013

(54) OBSTRUCTION DETECTOR POWER CONTROL

(75) Inventors: Steven A. Harlow, San Diego, CA (US); Paul D. Kahn, San Diego, CA (US); Mark C. Mattson, Carlsbad, CA (US)

(73) Assignee: Linear LLC, Carlsbad, CA (US)

( * ) Notice: Subject to any disclaimer, the term of this patent is extended or adjusted under 35 U.S.C. 154(b) by 177 days.

(21) Appl. No.: 12/986,815

(22) Filed: Jan. 7, 2011

(65) Prior Publication Data

US 2012/0174483 A1 Jul. 12, 2012

(51) Int. Cl.
*E05F 15/20* (2006.01)

(52) U.S. Cl.
USPC ..... 49/28; 49/199

(58) Field of Classification Search
USPC ..... 49/26, 27, 28, 197, 199; 318/266, 318/466
See application file for complete search history.

(56) References Cited

U.S. PATENT DOCUMENTS 4,408,146 A * 10/1983 Beckerman ..... 318/264
4,914,859 A * 4/1990 Gionet et al. ..... 49/25
5,285,136 A * 2/1994 Duhame ..... 318/266
5,428,923 A * 7/1995 Waggamon ..... 49/28
5,584,145 A * 12/1996 Teich ..... 49/506
5,929,580 A * 7/1999 Mullet et al. ..... 318/466
6,326,751 B1 * 12/2001 Mullet et al. ..... 318/434
6,329,774 B1 * 12/2001 Ariav ..... 318/282
6,437,527 B1 * 8/2002 Rhodes et al. ..... 318/280
6,732,476 B2 * 5/2004 Mehalshick et al. ..... 49/506
6,737,968 B1 * 5/2004 Ergun et al. ..... 340/540
6,879,122 B1 * 4/2005 Stewart et al. ..... 318/280
7,208,897 B2 * 4/2007 Hotto et al. ..... 318/466
7,265,508 B1 * 9/2007 Karasek et al. ..... 318/280
7,315,143 B2 * 1/2008 Mullet et al. ..... 318/280
7,327,108 B2 * 2/2008 Mullet et al. ..... 318/280
7,420,347 B2 * 9/2008 Fitzgibbon ..... 318/478
7,525,267 B2 * 4/2009 Angiuli et al. ..... 318/282
7,635,960 B2 * 12/2009 Mullet et al. ..... 318/280
7,755,223 B2 * 7/2010 Fitzgibbon ..... 307/326
7,762,304 B2 * 7/2010 La Marca et al. ..... 160/8
7,855,475 B2 * 12/2010 Fitzgibbon ..... 307/125
2003/0025470 A1 * 2/2003 Fitzgibbon et al. ..... 318/66
2003/0154656 A1 * 8/2003 Fitzgibbon et al. ..... 49/26
2004/0006918 A1 * 1/2004 Fitzgibbon ..... 49/28
2004/0088922 A1 * 5/2004 Miller et al. ..... 49/26
2004/0261317 A1 * 12/2004 Murray ..... 49/26
2006/0071624 A1 * 4/2006 Fitzgibbon ..... 318/280
2006/0197481 A1 * 9/2006 Hotto et al. ..... 318/280
2007/0075655 A1 * 4/2007 VanDrunen et al. ..... 318/66
2007/0157518 A1 * 7/2007 Galberti et al. ..... 49/26
2008/0012515 A1 * 1/2008 Murray ..... 318/466
2008/0184622 A1 * 8/2008 Mullet et al. ..... 49/26
2009/0282740 A1 * 11/2009 Nassimi ..... 49/28
2010/0257784 A1 * 10/2010 Fitzgibbon ..... 49/26

* cited by examiner

*Primary Examiner* — Katherine Mitchell
*Assistant Examiner* — Justin Rephann
(74) *Attorney, Agent, or Firm* — DLA Piper LLP (US)

(57) ABSTRACT

A method of powering an obstruction detector. Power is provided to an obstruction detector when a motor is executing a first movement and is suppressed to the obstruction detector when the motor is idle and when the motor is executing a second movement. The first movement moves a movable barrier towards a closed position, and the second movement moves the barrier towards an open position.

7 Claims, 2 Drawing Sheets

OBSTRUCTION DETECTOR POWER CONTROL

BACKGROUND OF THE INVENTION

1. Field of the Invention

This invention relates to obstruction detector power control for a barrier movement operator.

2. Description of Related Art

Barrier movement operators, such as garage door openers, are typically activated either by a wireless remote or by a wall-mounted switch. When activated, a motor is energized to move the barrier in either a forward or reverse direction toward an open or closed position. An obstruction such as an automobile or person that encounters a closing barrier can suffer serious damage. Thus, for example, conventional garage door openers may include an obstruction detector that halts downward motion of the door if the obstruction detector is tripped.

A barrier movement operator is in standby and not in use most of the time. During this standby time, the barrier movement operator continues to consume energy. Commonly, power is provided from a switching regulated main 26V power supply. The inventors have recognized that an obstruction detector during standby consumes more power than any other component of the barrier movement operator. In conventional systems, the obstruction detector consumes nearly a watt of power, which equals about a third of the total standby power consumption of the barrier movement operator.

SUMMARY OF THE INVENTION

The present invention provides a barrier movement operator that detects obstructions and is able to lower power usage, regardless of the type of power supply. In particular, when operating under battery back-up power, standby power consumption is reduced by almost a watt over conventional systems and increases battery back-up endurance time from about 16 hours to about 28 hours.

One embodiment of the invention is a method of powering an obstruction detector, including providing power to an obstruction detector when a motor is executing a first movement; and suppressing power to the obstruction detector when the motor is idle and when the motor is executing a second movement. The first movement may move a movable barrier towards a closed position, and the second movement may move the barrier towards an open position. Power may be provided to the obstruction detector when a switch, such as a light switch, is activated. The power supplied to the obstruction detector may be from a battery back-up power supply. The obstruction detector may detect an obstruction along a predetermined path.

Another embodiment of the invention is a barrier movement operator including a movable barrier, a motor connected to the movable barrier, and an obstruction detector detecting obstructions along a predetermined path. A processor is connected to the motor and the obstruction detector. An operation control unit is connected to the processor. The processor grants power to the obstruction detector when the motor is executing a first movement, and suppresses power to the obstruction detector when the motor is idle and when the motor is executing a second movement. The operation control unit may include a wired control unit and a wireless receiver unit. The obstruction detector may include an optical source and an optical sensor. A battery back-up power supply may provide power to the obstruction detector. A light may be controlled by the operation control unit, wherein power is provided to the obstruction detector when the light is powered on. The movable barrier may be selected from a group consisting of an elevator door, a garage door, a solid door, a gate, a window, a shutter, a milling machine and press. The obstruction detector may include at least one surge protector element.

Another embodiment of the invention is an obstruction detector including a controller that grants power to an obstruction detector when a motor is executing a first movement and suppresses power to the obstruction detector when the motor is idle and when the motor is executing a second movement. The obstruction detector may include an optical source and an optical sensor. The controller may include at least one surge protector element, and a signal shifter to shift a level of a detected obstruction signal to a level appropriate for a movable barrier operator. The obstruction detector may be used in conjunction with a movable barrier. The first movement may be stopped when the obstruction detector detects an obstruction.

Other features and advantages of the invention will be apparent from the following detailed description, taken in conjunction with the accompanying drawings that illustrate, by way of example, various embodiments of the invention.

DETAILED DESCRIPTION OF THE INVENTION

Figure 1:
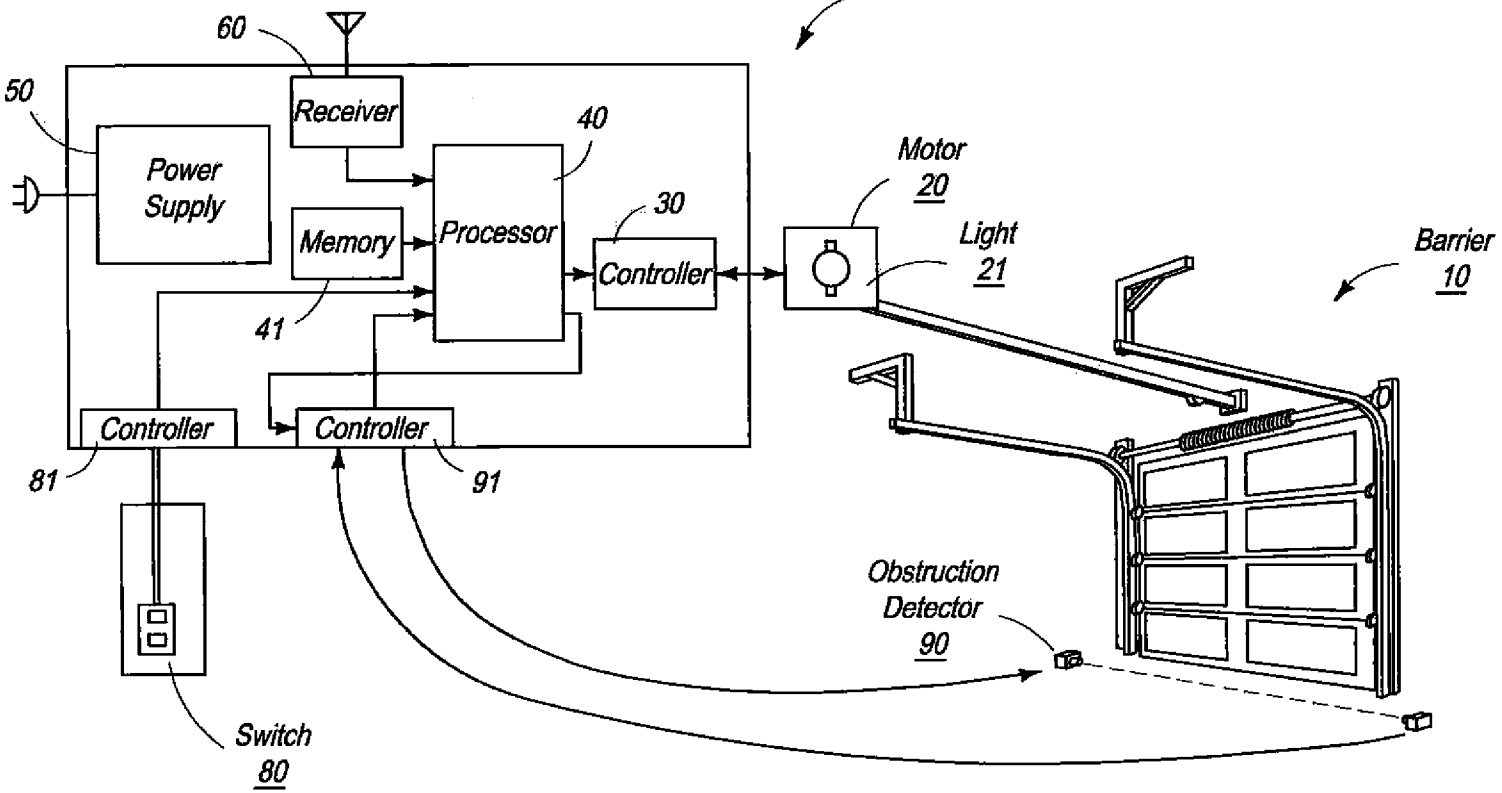
FIG. 1 is a block diagram of a barrier movement operator system according to one embodiment of the invention.

FIG. 1 is a diagram of a barrier movement operator system 100. System 100 includes movable barrier 10, motor 20, light 21, motor controller 30, processor 40, power supply 50, obstruction detector 90 and obstruction detector controller 91. System 100 may also include an operation control unit including one or more of a wireless receiver 60, a wireless remote, wired control unit 80 and wired control unit controller 81.

System 100 opens and closes movable barrier 10 between different positions. Barrier 10 is mounted on tracks and coupled to motor 20. Barrier 10 is pushed or pulled by motor 20 between open and closed positions. In FIG. 1, barrier 10 is in the closed position. Processor 40 is connected to and sends signals to motor controller 30 and obstruction detector controller 91 to control motor 20 and obstruction detector 90. Processor 40 is also connected to and receives signals from an operation control unit such as controller 81 and/or wireless receiver 60. Motor controller 30 converts control signals provided by processor 40 into drive signals for motor 20 to cause motor 20 to function in a desired manner. Motor controller 30 is connected to light 21, which shares a common housing with motor 20. Alternatively, light 21 may be provided separate from motor 20 and motor controller 30 and may include a plurality of lights.

Memory 41 may be a read-only memory (ROM) and is a non-transitory computer readable storage medium that stores control programs necessary to operate system 100. Battery back-up power supply 50 powers system 100 when a regular power source is unavailable. Back-up power supply 50 ensures that barrier 10 and obstruction detector 90 can still be operated in the event of a power outage.

Wired control unit controller 81 and wireless receiver 60 provide input signals to processor 40 to move barrier 10. Wired control unit 80 may be a wall-mounted switch operated by the user, and may incorporate a light as well as other switches for additional functions and devices. For example, a switch to activate motor 20 may also activate one or more lights 21. A separate light switch may also be provided. Wired control unit controller 81 receives and processes input from wired control unit 80 and sends an appropriate signal to processor 40. Similarly, wireless receiver 60 receives and processes incoming commands from a wireless remote and sends a signal to processor 40.

Obstruction detector 90 detects obstructions along a predetermined path, such as along or near the movement arc of barrier 10. An object or obstruction that is detected by detector 90 along the predetermined path indicates an obstruction along a path of barrier 10. An obstruction that triggers the detection may be a person, a vehicle, or countless other objects. In FIG. 1, detector 90 includes an optical source and an optical sensor. The optical source is placed on a first side on or near barrier 10 and the optical sensor is provided on an opposite second side on or near barrier 10. When the optical sensor detects a beam signal emitted from the optical source, obstruction detector controller 91 determines that no obstruction is detected. When the optical sensor no longer detects the optical sensor signal emitted by the optical source, obstruction detector controller 91 determines that an obstruction is present along the path of barrier 10. This signal is sent to processor 40, which instructs motor controller 30 to halt, reverse movement, or perform some other predetermined action with barrier 10. Of course, power must be provided to obstruction detector 90 in order for the determination of an obstruction to be carried out.

The present invention is not limited to the illustrated embodiment of obstruction detector 90 nor the specific placement shown in FIG. 1. Any implementation of an obstruction detector is contemplated for use with the present invention so long as obstructions along a path of a movable barrier are detectable. The method of powering the obstruction detector can be executed by a computer-readable program stored on non-transitory storage memory 41 and executed by processor 40 and is discussed below.

Processor 40 grants power to obstruction detector 90 when motor 20 moves barrier 10 towards a closed position, and suppresses power to detector 90 when motor 20 is idle and when motor 20 moves barrier 10 towards an open position. Therefore, the movement state of barrier 10 determines if power is provided to detector 90. Power consumption of detector 90 is thereby limited specifically to time periods when the use of detector 90 is necessary and useful. When barrier 10 is not moving or is moving towards an open position, there is no risk of barrier 10 collapsing on top of an obstruction. Therefore, detector 90 is not powered at that time. Thus, when powering obstruction detector 90 does not contribute to safe operation of system 100, power is not supplied to detector 90. In this regard, the present invention reduces energy usage not only during the entire standby time when motor 20 is idle, but also during the entire movement of barrier 10 towards the open position.

In an alternative embodiment, power is also provided to obstruction detector 90 by processor 40 when light 21 is powered on. Therefore, when a light switch is activated, detector 90 is supplied with energy. Detector 90 can also be activated when installation/alignment of system 100 is performed. An installation/alignment signal can be incorporated into the light switch or as an independent switch. If regular power supply is unavailable, then battery back-up power supply 50 supplies power to detector 90.

Figure 2:
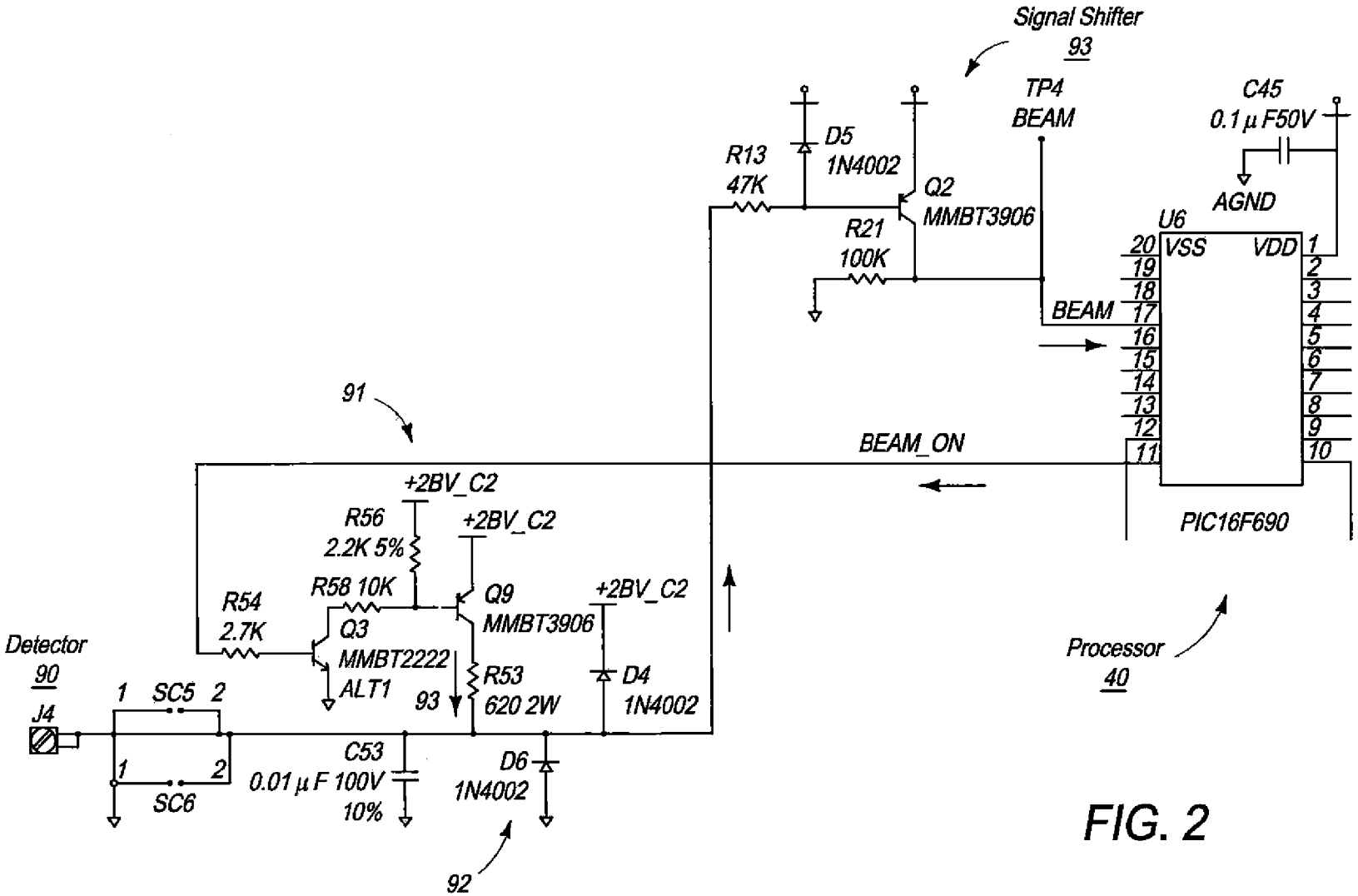
FIG. 2 is an electronic schematic of another embodiment of the present invention.

FIG. 2 is an electronic circuit diagram showing a non-limiting example of one implementation of the present invention. A power control circuit is provided in FIG. 2 including two transistors Q3 and Q9 that control the operation of obstruction detector 90. The circuit is connected to obstruction detector 90 at J4. Processor 40 (U6) provides a BEAM_ON signal to obstruction detector controller 91 to turn on the beam. Transistors Q3 and Q9 and associated resistors comprise the power control circuitry while protection elements SG5, SG6, C53, D6 and D4 absorb or deflect surges. Signal shifter 93 incorporates the components from resistor R13 to transistor Q2 while obstruction detector controller 91 includes the components from SG5 to D4. Signal shifter 93 shifts the level of the obstruction detector signal to a level appropriate for processor 40.

Controller 91 grants power to obstruction detector 90 when a motor moves barrier 10 toward a closed position and suppresses power to detector 90 when the motor is idle and when the motor moves barrier 10 towards an open position. For example, the BEAM_ON signal is a standard logic level signal. Transistor Q3 shifts the signal level to be appropriate to drive the switch transistor. Transistor Q9 switches a +28V power to obstruction detector 90. The downward arrow adjacent to resistor R55 indicates the path of power through obstruction detector controller 91.

The power usage restrictions placed on obstruction detector 90 reduce overall power consumption. When used in conjunction with a back-up power supply, the endurance time of the battery back-up is increased because standby power consumption is reduced dramatically. By contrast, conventional systems have high standby power requirements because an obstruction detector beam remains on.

Following is an example of pseudo code in one embodiment that is executed by a processor to control the BEAM_ON signal.

```
if(moving_barrier_down||(not_on_battery_backup_power&&wall_station_light_switch_on)
{
    BEAM_ON = 1;
}
else{
    BEAM_ON = 0;
}
```

The embodiments of the invention described in this document are illustrative and not restrictive. Modification may be made without departing from the spirit of the invention as defined by the following claims. For example, the invention is not limited to garage door 10 illustrated in FIG. 1, and is equally applicable to other types of barriers that open and close such as elevator doors, gates, solid doors, windows, shutters, milling machines and presses. Moreover, the invention is not limited to the circuit configuration of FIG. 2. For example, transistor Q9 can be a field effect transistor (FET) or a relay rather than a bipolar transistor, and hardware logic such as transistors, logic gates or an FPGA may be used in place of a microcontroller.

The invention claimed is:

1. A barrier movement operator comprising:

a movable barrier;

a motor connected to the movable barrier;

an obstruction detector detecting obstructions along a predetermined path;

a processor connected to the motor and the obstruction detector; and an operation control unit connected to the processor, wherein the processor is preprogrammed to grant power to the obstruction detector when the motor is executing a closing movement, and is preprogrammed to suppress all power to the obstruction detector when the motor is idle and when the motor is executing an opening movement.

2. The barrier movement operator of claim 1, wherein the operation control unit includes a wired control unit and a wireless receiver unit.

3. The barrier movement operator of claim 1, further comprising a battery back-up power supply providing power to the obstruction detector.

4. The barrier movement operator of claim 1, wherein the obstruction detector comprises an optical source and an optical sensor.

5. The barrier movement operator of claim 1, further comprising a light controlled by the operation control unit, wherein power is provided to the obstruction detector when the light is powered on.

6. The barrier movement operator of claim 1, wherein the movable barrier is selected from a group consisting of an elevator door, a garage door, a solid door, a gate, a window, a shutter, a milling machine and a press.

7. The barrier movement operator of claim 1, wherein the obstruction detector includes at least one surge protector element.

* * * * *